US005310190A

United States Patent [19]

Morris

[11] Patent Number: 5,310,190

[45] Date of Patent: May 10, 1994

[54] WESTERN GAME BOARD APPARATUS

[76] Inventor: Richard D. Morris, R.R. 1, Box 146B, Jasonville, Ind. 47438

[21] Appl. No.: 96,553

[22] Filed: Jul. 23, 1993

[51] Int. Cl.[5] ..... A63F 3/00

[52] U.S. Cl. ..... 273/243; 273/281; 273/142 A

[58] Field of Search ..... 273/243, 242, 281, 282.3, 273/142 A, 142 D, 142 G

[56] References Cited

U.S. PATENT DOCUMENTS

| | | | |
|---|---|---|---|
| 1,257,045 | 2/1918 | Stotler . | |
| 2,486,752 | 11/1949 | Michael . | |
| 2,610,854 | 9/1952 | Card . | |
| 3,769,743 | 11/1973 | Benkoe et al. . | |
| 3,779,556 | 12/1973 | Johmann | 273/243 |
| 3,861,686 | 1/1975 | Breslow et al. | 273/243 X |
| 3,984,105 | 10/1976 | Breslow | 273/243 |
| 4,022,474 | 5/1977 | Breslow et al. . | |
| 4,157,183 | 6/1979 | Meyer et al. | 273/243 |
| 4,244,568 | 1/1981 | Ferris et al. . | |

FOREIGN PATENT DOCUMENTS

| | | | |
|---|---|---|---|
| 570347 | 1/1933 | Fed. Rep. of Germany | 273/142.4 |
| 683861 | 6/1930 | France | 273/142 |

*Primary Examiner*—William Stoll
*Attorney, Agent, or Firm*—Locke Reynolds

[57] ABSTRACT

A board game is provided to have a board defining a plurality of pockets symmetrically situated around a periphery of the board and a plurality of depressions for accepting movable game pieces. A rotating shaft of an electric motor is positioned in the center of the board, the electric motor being powered by a battery and controlled by a switch. An outwardly extending arm is attached to rotate with the shaft. A horse figure is permanently attached to the rotating arm, the horse figure being configured to pass over the plurality of pockets. Atop the horse figure is positioned a cowboy figure separate from and removably connected to the horse figure. A plurality of bumps and ridges are positioned between the plurality of pockets and a center of the board for jostling contact with the arm and the connected horse figure and cowboy figure, causing random or semirandom detachment of the cowboy figure from the horse figure, with the cowboy figure falling into one of the plurality of pockets to determine movement of game pieces.

11 Claims, 2 Drawing Sheets

WESTERN GAME BOARD APPARATUS

BACKGROUND AND SUMMARY OF THE INVENTION

The present invention relates to game board devices for amusement. In particular the present invention relates to a game board device for moving a game controlling element that can randomly fall into a board cavity or pocket.

Mechanically operated games are popular with children because of the activity of the game pieces and the opportunity to interact and control the moving game pieces. One popular class of games includes board games having movement of playing pieces or elimination of players determined by roll of dice or other randomizing elements. These types of games are widely known and available, and have an enduring popularity with children.

For example, U.S. Pat. No. 3,984,105 to Breslow includes a game board having a centrally situated variable speed motor. A toy motorcycle is tethered to the motor so that the motorcycle can rotate about the motor along a circular travel path. Playing pieces and obstacles can be placed in the travel path to allow performance of stunts, such as jumping or maneuvering to obtain game points. Although the toy motorcycle includes a human figure with a motorcycle helmet, the figure is not detachable, and is not intended to be separated from the motorcycle to control game flow or patterns.

Other board games are also known to have rotating elements for assisting in game play. As an example, Ferris, U.S. Pat. No. 4,244,568 describes a manually cranked toy bee that is capturable by toy frog mouths situated around the circular path of travel of the bee. Other examples include U.S. Pat. Nos. 1,257,045; 2,486,752; and 4,022,474, all of which rely on rotating elements to provide for random or semi-random game play.

The present invention provides a novel board game having manually or electrically powered elements for determining game play. The board game of the present invention includes a board defining a plurality of pockets and a movable mechanism having an outwardly extending arm and a holder attached to the arm. The holder is configured to pass over the plurality of pockets as the arm moves across the board. A detachable figure separate from and removably connected to the holder is positioned on the holder, and a game action is provided by a mechanism that may include bumps or ridges in the game board for jostling the holder to cause random or semirandom detachment of the figure from the holder. Upon detachment, the figure falls into one of the plurality of pockets to determine game play and movement of game pieces.

In preferred embodiments, the movable mechanism includes an electric motor that rotates a shaft, with the electric motor being powered by a replaceable battery. Typically, the plurality of pockets are symmetrically defined and evenly spaced along the periphery of the board. A plurality of bumps and ridges are defined to lie between the plurality of pockets and the electric motor, acting to jostle the holder, which typically is a horse figure constructed from plastic or wood. The detachable figure is a cowboy figure that can be seated or mounted upon the horse figure, but is not rigidly attached to the horse figure. After receiving multiple jostling impacts, the cowboy figure falls from the horse, and comes to rest in one of the pockets defined in the board.

In an alternative embodiment, the board game includes a board, a plurality of catchment devices positioned around the board, and a mechanism for moving an outwardly extending arm in a circle. A holding mechanism, such as a horse figure, is attached to the outwardly extending arm, and the holding mechanism is configured to pass over or adjacent to the plurality of pockets. Also provided is a detachable figure separate from and removably connected to the holding mechanism. The holding mechanism is jostled as the outwardly extending arm contacts bumps or ridges defined in the game board, causing random or semirandom detachment of the figure from the holding mechanism, with the figure falling into one of the plurality of catchment devices to determine game play.

Advantageously, the present invention enhances static board game play with the random or semi-random "bucking" action of the motor controlled horse figure. After some indeterminate amount of bucking, the cowboy figure falls into a pocket, the particular pocket into which the cowboy falls determining movement of game pieces. This provides a lively and enjoyable game for children that can be economically produced and distributed.

Other objects, features, and advantages of the invention will be apparent upon consideration of the accompanying drawings and detailed description of the invention.

DETAILED DESCRIPTION OF THE INVENTION

Figure 1:
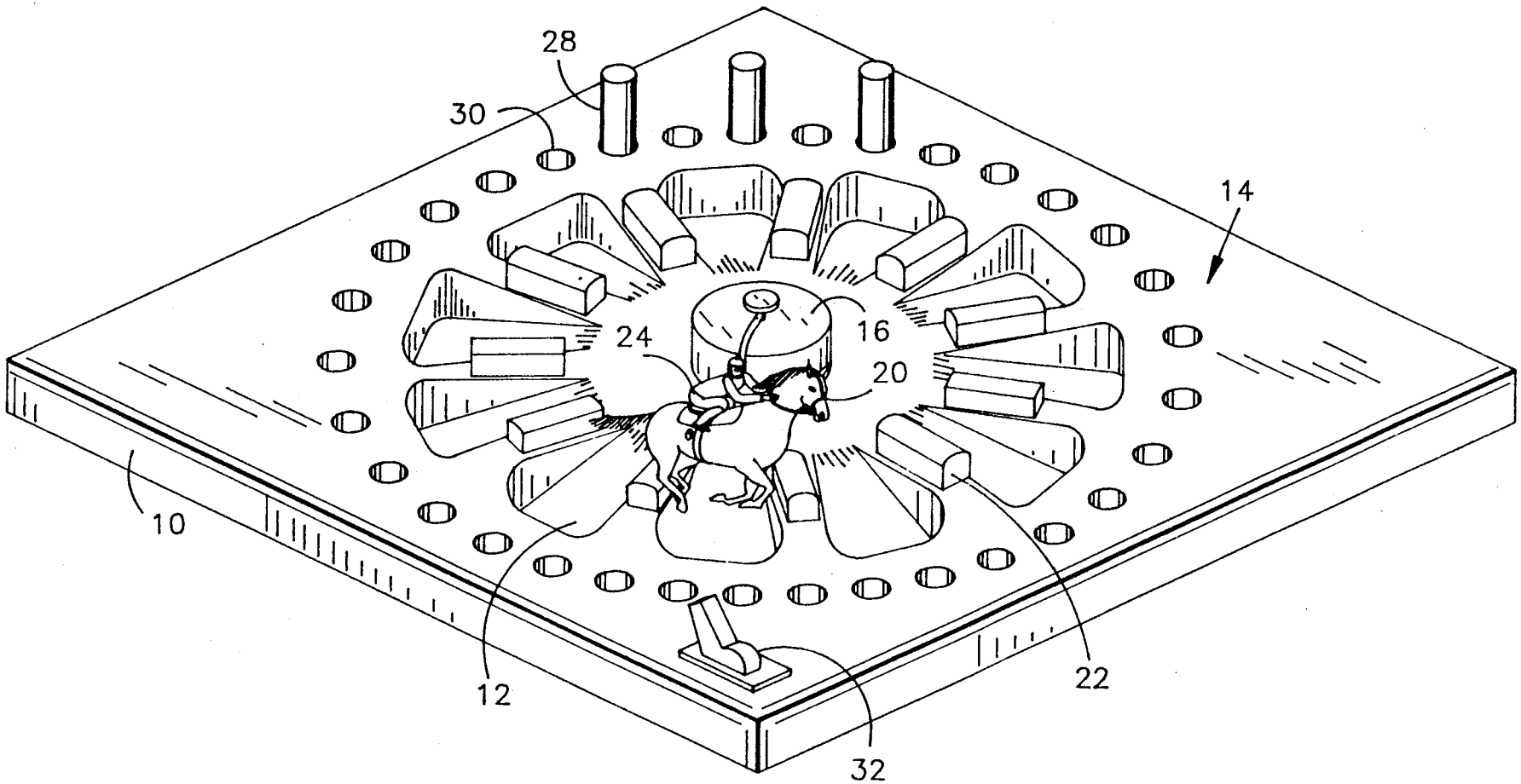
FIG. 1 is a schematic perspective view of a game board showing the centrally situated motor and pockets defined along a periphery of the game board to receive a cowboy figure positioned atop a horse figure when the cowboy is jolted or knocked from the horse.

A game board 10 for playing a western theme board game is generally indicated in FIG. 1. A top surface 14 of the board 10 is indented to define a plurality of petal shaped pockets 12 that are regularly spaced around the periphery of the board 10, giving an appearance somewhat similar to a radially symmetrical flower. In addition, smaller depressions 30 are also formed in the top surface 14 to surround in a ring the pockets 12, and bumps or ridges 22 can be defined between pockets 12 and the center Of the board 10. Playing pieces 28 can be moved in a circle around the board, resting in turn in the depressions 30. As those skilled in the art will appreciate, the exact size, spacing, and orientation of the pockets, depressions, or other catchment type features can be varied, with non-symmetrical layouts or designs also within the contemplation of the present invention.

The board 10 can be formed from metal, wood, or plastic. In preferred embodiments the board is formed by vacuum molding plastics. In other embodiments, pockets and depressions are carved in the board. For enhanced visual appearance, the top surface can be impressed with western images or symbols such as cowboys, horses, or western landscapes, and any necessary game symbols or numbering can be molded, carved, painted or affixed by silk screen impression or other conventional image fixing techniques to the top surface 14.

Figure 2:
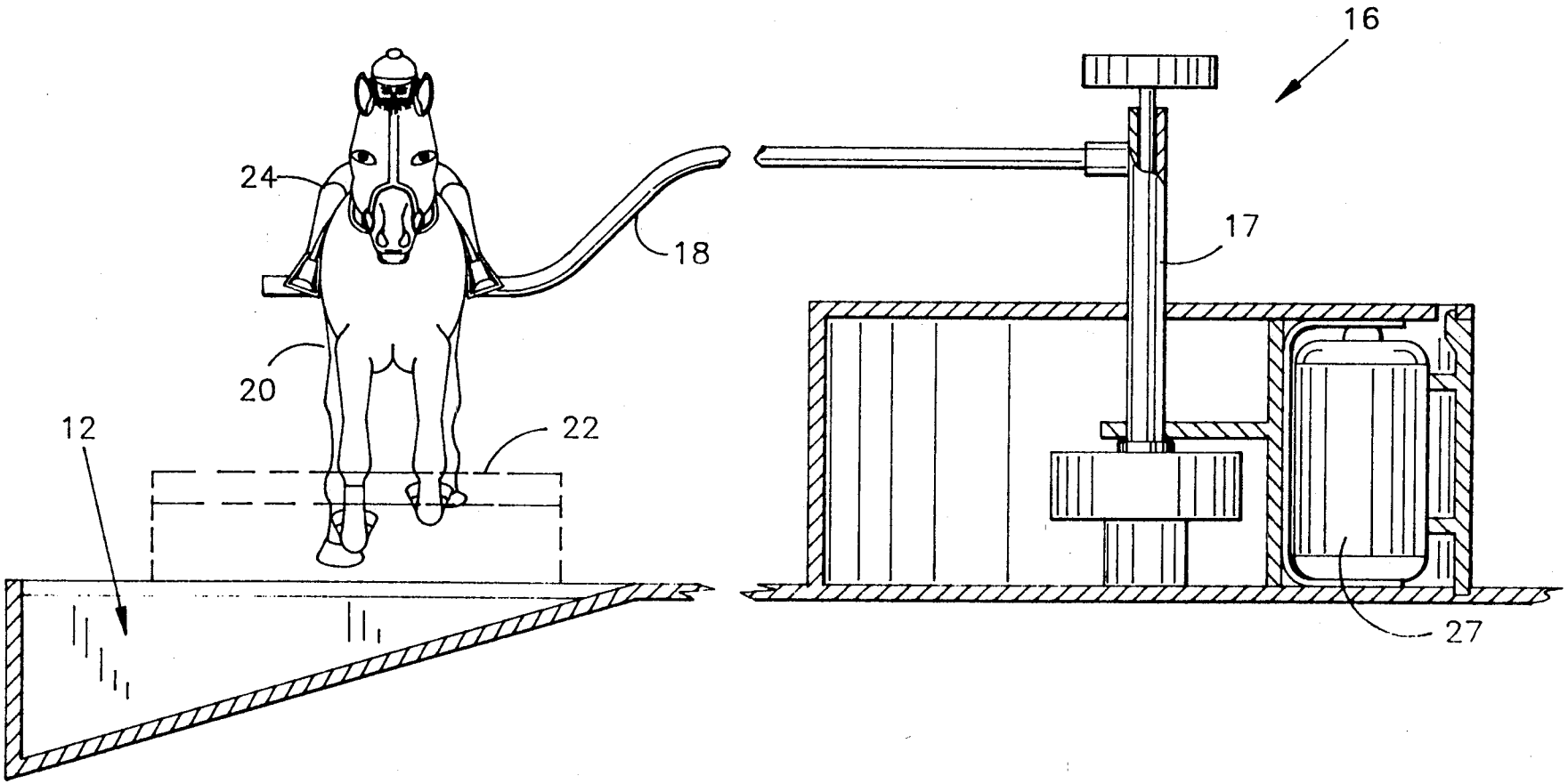
FIG. 2 is a side cross sectional view of the board illustrating a typical pocket defined in the game board, a bump (in phantom outline) for contacting and jostling an arm attached between the motor and horse figure, and the centrally located, battery powered electric motor.

As seen in FIG. 1, and in cross section in FIG. 2, a motor drive mechanism 16 is centered on top of the board. The motor drive mechanism 16 has a shaft 17 attached to move an arm 18 in a circle. A horse FIG. 20 formed from wood or plastic is attached to the end of the arm, moving in a circle adjacent to and over the pockets 12. The horse FIG. 20 is configured to hold a cowboy FIG. 24, also formed from wood or plastic. The cowboy figure 24 is not permanently attached to the horse, but merely rests upon the horse's back. Jolting, jostling, or bumping movement of the horse (i.e., "bucking") can dismount the cowboy FIG. 24. Bucking motion by the horse FIG. 20 is encouraged by contact between the arm 18 attached to the horse FIG. 20 and bumps or ridges 22 as the horse figure 20 moves in a circle. Once the cowboy FIG. 24 is dislodged, it falls into one of the pockets 12. Game play continues according to which one of the marked pockets the FIG. 24 randomly or semi-randomly falls into, with pieces 28 being moved around the board 10. To aid in differentiating the pockets, it is of course possible to color code, number, or otherwise mark with suitable visual indicia each pocket.

In the embodiment illustrated, the motor 16 and its shaft 17 is electrically powered by a replaceable "D"-cell battery 27. On and off operation is controlled by either a switch 26 adjacent to the motor 16, or during game play by a switch 32 at the edge of the board. In operation, a game player places the cowboy FIG. 24 on top of the horse FIG. 20. The switch 32 is depressed, and the shaft 17, connected arm 18, and horse 20 rotates around the board. As the horse rotates, the arm 18 keeps on striking the bumps and ridges 22, throwing the horse up and down as it proceeds in a circle. This bucking action continues until the cowboy FIG. 24 is thrown from the horse into a pocket. The switch 32 is turned to an off position, and game pieces 28 are moved according to a predefined set of rules and the particular pocket into which the cowboy 24 has fallen. After this turn is complete, it is another player's turn to place a cowboy figure on the horse and complete a game turn.

As those skilled in the art will appreciate, it is possible to use variable speed electric motors, non-battery powered motors, hand. cranked mechanical movers, or other conventional moving mechanisms to move the horse. In addition, circular motion is not required, and elliptical, linear back-and-forth, or more complex travel paths for the horse are also within the contemplation of the present invention.

While the present invention has been described in connection with specific embodiments, it will be apparent to those skilled in the art that various changes may be made therein without departing from the spirit or scope of the invention as defined in the following claims.

The claimed invention is:

1. A board game comprising a board defining a plurality of pockets, a movable mechanism having an outwardly extending arm and a holder attached to the arm, the holder being configured to pass over the plurality of pockets, a detachable figure separate from and removably connected to the holder, and means for jostling the holder to cause random or semirandom detachment of the figure from the holder, with the figure falling into one of the plurality of pockets to determine game play.

2. The board game of claim 1, wherein the movable mechanism comprises an electric motor that rotates a shaft, the electric motor being powered by a battery.

3. The board game of claim 1, wherein the plurality of pockets are symmetrically defined along the periphery of the board.

4. The board game of claim 1, wherein the means for jostling the holder further comprises a plurality of bumps and ridges defined to lie between the plurality of pockets and a center of the board.

5. The board game of claim 1, wherein the holder is a horse figure and the detachable figure is a cowboy figure.

6. A board game comprising a board defining a plurality of pockets symmetrically situated around a periphery of the board and a plurality of depressions for accepting movable game pieces, a rotating shaft of an electric motor positioned in the center of the board, the electric motor being powered by a battery and controlled by a switch, an outwardly extending arm attached to the shaft for rotational movement therewith, a horse figure attached to the rotating arm, the horse figure being configured to pass over the plurality of pockets, a cowboy figure separate from and removably connected to the horse figure, and a plurality of bumps and ridges positioned between the plurality of pockets and a center of the board for jostling the outwardly extending arm and the combined horse figure and cowboy figure, causing random or semirandom detachment of the cowboy figure from the horse figure, with the cowboy figure falling into one of the plurality of pockets to determine movement of game pieces.

7. A board game comprising a board, a plurality of catchment devices positioned around the board, means for moving an outwardly extending arm, means for holding attached to the outwardly extending arm, the holding means being configured to pass over or adjacent to the plurality of catchment devices, a detachable figure separate from and removably connected to the holder, and means for jostling the holder to cause random or semirandom detachment of the figure from the holding means, with the figure falling into one of the plurality of catchment devices to determine game play.

8. The board game of claim 7, wherein the movable mechanism comprises an electric motor that rotates a shaft, the electric motor be powered by a battery.

9. The board game of claim 7, wherein the catchment devices further comprise a plurality of pockets symmetrically defined along the periphery of the board.

10. The board game of claim 7, wherein the means for jostling the holder further comprises a plurality of bumps and ridges defined to lie between the plurality of pockets and a center of the board.

11. The board game of claim 7, wherein the holding means further comprises a horse figure and the detachable figure is a cowboy figure.

* * * * *